United States Patent [19]

Hartline

[11] Patent Number: 4,780,918

[45] Date of Patent: Nov. 1, 1988

[54] SOFA BED WITH FRICTION STOP

[75] Inventor: Michael F. Hartline, Saltillo, Miss.

[73] Assignee: Super Sagless Corporation, Tupelo, Miss.

[21] Appl. No.: 47,168

[22] Filed: May 7, 1987

[51] Int. Cl.[4] ..... A47C 17/04

[52] U.S. Cl. ..... 5/13; 5/29

[58] Field of Search ..... 5/13, 28, 29, 31–36

[56] References Cited

U.S. PATENT DOCUMENTS 3,284,812 11/1966 Koch ..... 5/13
3,380,083 5/1968 Mikos ..... 5/13
3,903,553 9/1975 Metayer ..... 5/36
4,439,878 4/1984 Stevens ..... 5/13 X

FOREIGN PATENT DOCUMENTS 1094354 12/1967 United Kingdom ..... 5/13

*Primary Examiner*—Michael F. Trettel
*Attorney, Agent, or Firm*—Wolf, Greenfield & Sacks

[57] ABSTRACT

A sofa bed having a friction damper on the main angle of the bed frame, which prevents the front tube and front legs of the frame from rapidly swinging forward as the frame is opened to prevent injury to the operator.

13 Claims, 4 Drawing Sheets

SOFA BED WITH FRICTION STOP

INTRODUCTION

This invention relates to sofa beds and more particularly to a sofa bed frame which when closed or retracted is in the sofa configuration and when open or extended is in the bed configuration.

Sofa beds have enjoyed substantial increases in sales as the higher cost of real estate has resulted in smaller dwelling units. With their increased popularity, substantial development has been directed to making sofa beds more comfortable both in the sleeping and seating configurations. One rather obvious method of increasing sleeping comfort is to provide sofa beds with thicker and firmer mattresses. However, the thicker and firmer mattresses create storage problems within the limited confines of the sofa frame when the frame is closed. One such problem results from the greater forces exerted by the folded mattress against the sofa bed frame which urges the frame to open. While in the process of opening the locked front section of the frame, the stored energy of the contained mattress is released, which may cause the front section comprising the front tube and front leg to swing rapidly toward the operator with sufficient force to cause serious injury.

The principal object of the present invention is to provide means incorporated into the sofa bed frame which allow the normal opening sequence to occur without the sudden and potentially dangerous rapid opening of the frame.

To accomplish the principal and other objects of the present invention, a friction link is incorporated into the frame, which must be drawn over the face of the main angle of the frame as the frame progresses from the closed to the open position. The friction link thus prevents the front leg and front tube from gaining speed and opening too rapidly after the front leg lock link passes over center, and thereby prevents injury to the operator.

These and other objects and features of the present invention will be better understood and appreciated from the following detailed description of one embodiment thereof read in connection with the accompanying drawings.

BRIEF FIGURE DESCRIPTION

DETAILED DESCRIPTION

Figure 1:
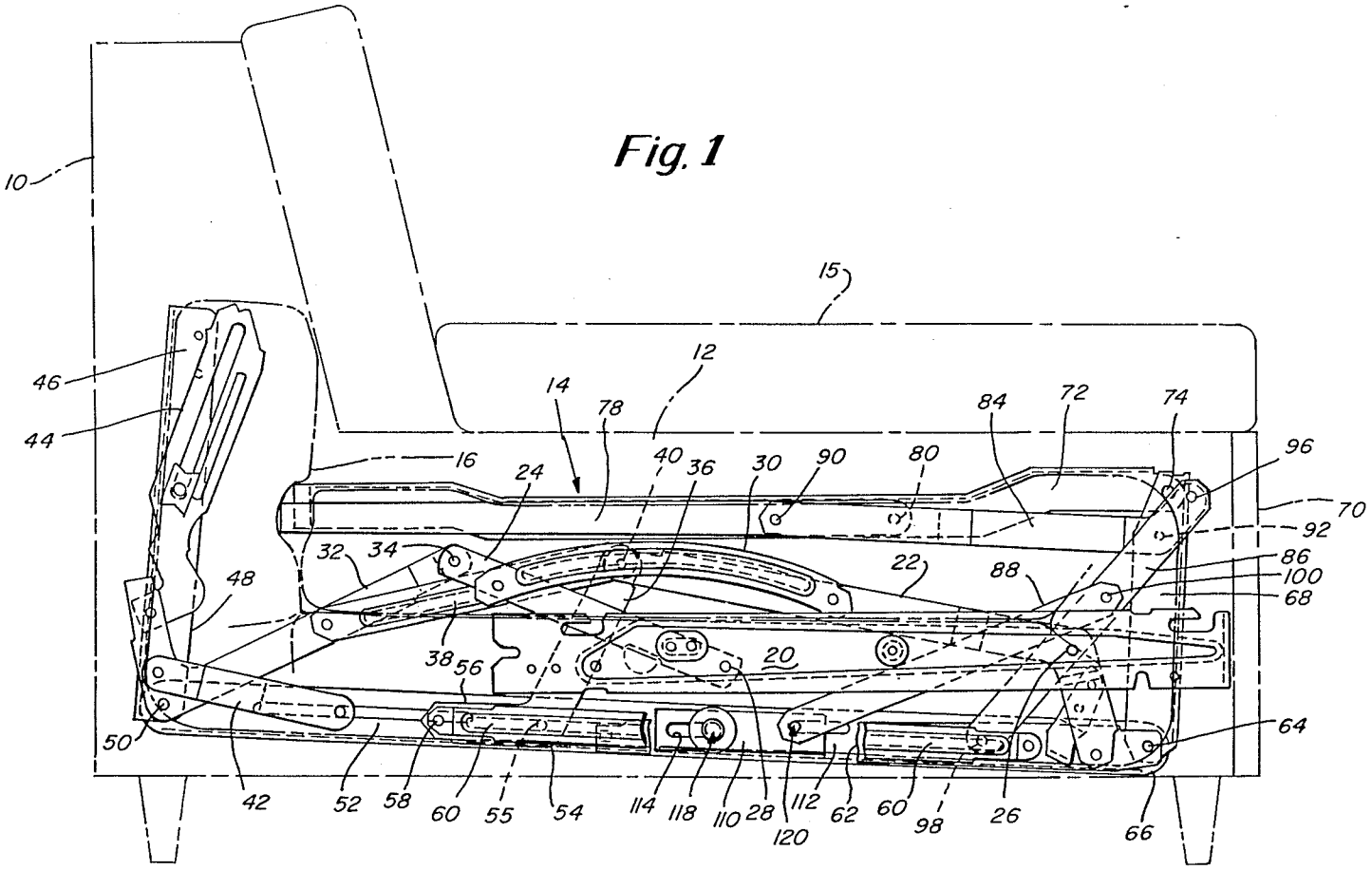
FIG. 1 is a side elevation view of a sofa bed frame constructed in accordance with this invention and shown positioned within the sofa in its closed or sofa configuration.

The sofa bed shown in the drawing includes a conventional back rest 10 and arms 12 which in turn support the sofa bed frame 14. When the sofa bed frame 14 is closed, or in the sofa configuration, seat pillows 15 rest on the top of the front portion of the sofa bed frame in the conventional manner. In addition, the sofa bed frame contains a mattress 16 suggested by broken lines in FIG. 1, which is folded within the sofa and frame when the frame is closed or retracted. When the sofa bed frame 14 is opened to the bed configuration, the mattress unfolds as suggested in FIG. 3 to provide a comfortable horizontal platform for sleeping.

Figure 2:
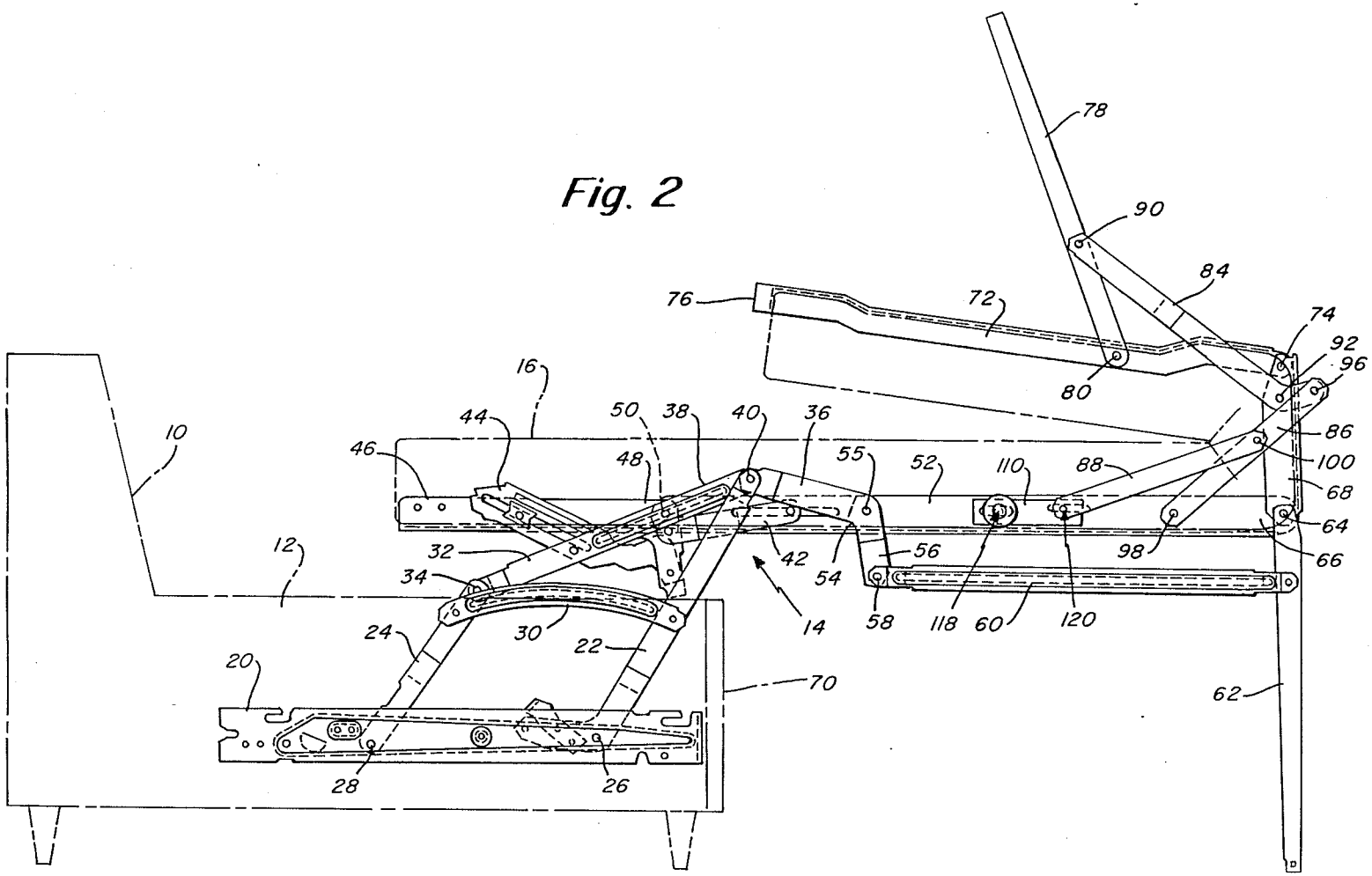
FIG. 2 is a side elevation view of the sofa bed frame shown in FIG. 1 but in its partially opened configuration.
Figure 3:
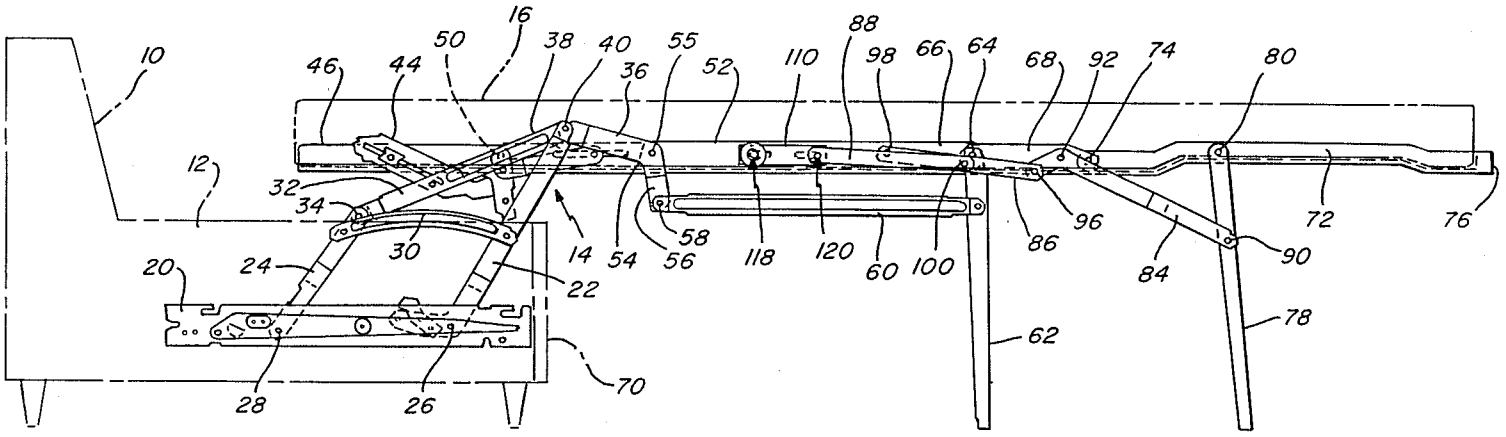
FIG 3 is a side elevation view similar to FIG. 2, but showing the sofa bed frame in its fully opened or bed configuration.
Figure 4:
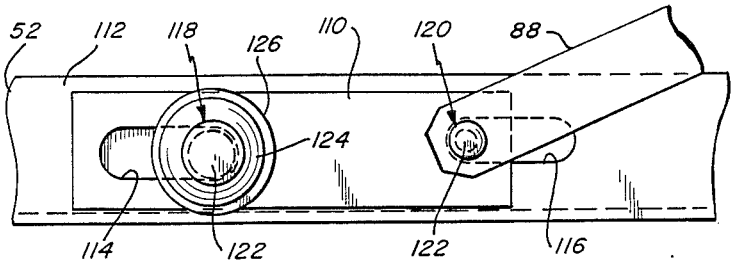
FIG. 4 is an enlarged fragmentary side view showing the relationship of the friction link and main angle of the sofa bed frame when the sofa bed frame is closed sofa configuration shown in FIG. 1.
Figure 5:
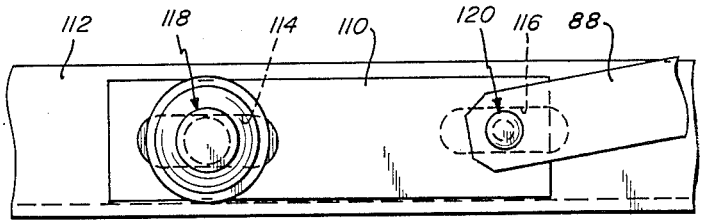
FIG. 5 is a view similar to FIG. 4, but showing the friction link and main angle in the partially opened position of FIG. 2.
Figure 6:
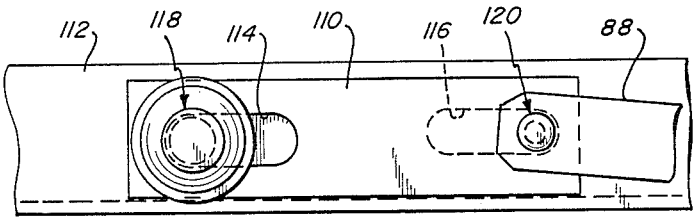
FIG. 6 is a view similar to FIGS. 4 and 5, but showing the friction link and main angle in the relationship assumed when the bed frame is in the bed or fully opened configuration of FIG. 3.
Figure 7:
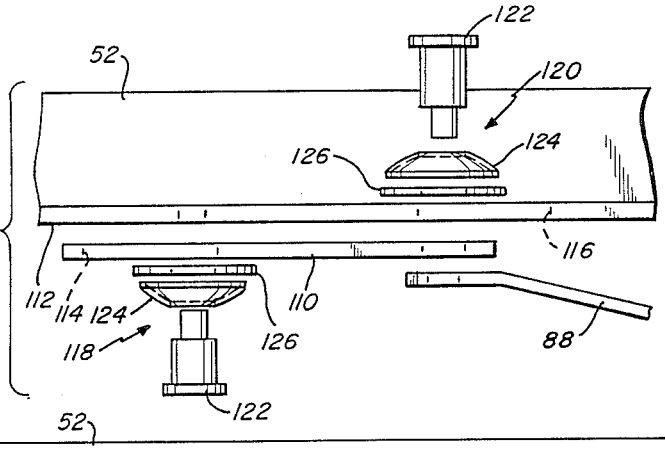
FIG. 7 is an exploded top view of the friction link, main angle and associated parts shown in FIGS. 4–6.

The sofa bed frame is secured to the inside of the sofa arms 12 by means of a pair of a chassis links 20, one of which is shown in FIGS. 1–3. In the following description, one side only of the sofa bed frame will be described and it will be appreciated that a duplicate arrangement is provided on each side of the sofa.

The chassis link 20 carries front and rear pivot links 22 and 24 that are respectively connected to the chassis link by rivets 26 and 28, respectively. The front and rear pivot links 22 and 24 are in turn connected intermediate their ends by rear link 30. The upper end of the rear pivot link 24 is pivotally connected at its upper end to the rear swing link 32 by rivet 34 while the upper end of the front pivot link 22 is connected to one end of bell crank 36 and the front end of drive link 38, by rivet 40. The rear part of the sofa bed frame also includes a latch link 44 and rear side angle 46, which together with rear swing link 32 function in the conventional manner and enable the rear portion of the sofa bed frame along with the rear end of the mattress to fold upwardly into the back rest 10 when the frame 14 is fully retracted to the sofa configuration. Latch link 44 also allows the rear angle 46 to be elevated to a TV position (not shown) when the frame 14 is opened to the bed configuration. Because the mechanism thus far described is well-known in the art, and because the details form no part of the present invention, they need not be described in greater detail herein.

As best illustrated in FIG. 1, the rear side angle 46 is pivotally connected at its front end 48 by rivet 50 to the main angle 52. The main angle 52 in turn pivotally supports the bell crank 36 by rivet 55 at its bend 54 (see FIGS. 2 and 3), and the bell crank 36 is connected at its end 56 by rivet 58 to the rear end of the rear leg control link 60. The front end of the rear leg control link 60 is pivotally connected to the rear leg 62 which is pivotally connected by rivet 64 to the front end of the main angle 52. The portion of the sofa bed frame 14 disposed within the main angles 52 (one on each side of the frame) supports the torso of the person reclining on the assembly when the sofa bed frame is open.

The front end 66 of the main angle 52 is also pivotally connected to the center angle 68 by the rivet 64. The center angle 68 is shown in FIGS. 1 and 2 to be disposed perpendicular to the main angle 52 when the sofa bed frame 14 is in the retracted or sofa configuration as well as when the sofa bed frame is partially withdrawn from the sofa with the mattress and main angle extending over the front rail 70 of the sofa. The other end of the center angle in turn is pivotally connected to the front tube 72 by rivet 74. The sides of the front tube 72 may be integrally formed with the transversely extending section 76 as suggested in the drawing. If made in that manner, the front tube ties the two sides of the frame 14 together. It will also be appreciated that cross members (not shown) and mattress supports (not shown) join the two sides of the frame 14 and permit the frame to close and open as desired.

Front leg 78 of the sofa bed frame 14 is pivotally connected by rivet 80 to the front tube 72 intermediate the front and back ends of the front tube, and the front leg in turn is operated by a front leg lock link 84, lock link 86 and control link 88. The front leg lock link 84 is connected by rivet 90 to the front leg 78 and carries a rivet 92 intermediate its ends that pivots on in the center angle 68. The other end of the front leg lock link 84 is connected by rivet 96 to one end of the lock link 86, and rivet 98 connects the other end of lock link 86 to the main angle 52. A rivet 100 pivotally joins one end of control link 88 with the intermediate portion of the lock link 86.

To move the sofa from the intermediate position wherein the front tube 72 and front leg 78 are horizontal, but with the main angle extending over the front rail 70 of the sofa frame (the position of FIG. 2 but with the front tube and leg 78 horizontal), the operator normally lifts up on the front leg 78 which pivots about rivet 80 on the front tube 72. This action causes the front leg lock link to pass from below the pivot point established by rivet 80 (see FIG. 1) to a point above that pivot. When the front leg lock link 84 passes over center in that manner the front tube and front leg are unlocked, and in the absence of some restraint upon the sofa bed frame, a heavy mattress compressed between the front tube and main angle may cause the front section of the sofa bed frame 14 to fly forward into the person operating the frame. That is, the front tube 72 may rapidly pivot about rivet 74 in a clockwise direction as viewed in FIG. 2 with the front leg 78 preceeding it so as to assume or approach the position shown in FIG. 3. The transverse section 76 of the front tube 72 and/or the front leg 78 may strike the operator and cause serious injury. The present invention is specifically intended to resist that action so as to prevent injury to the operator. This is accomplished by means of the friction link 110 and its associated parts.

Figure 8:
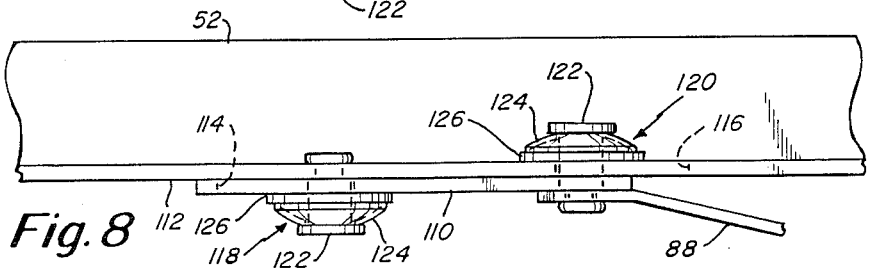
FIG. 8 is top plan view of the friction link and main angle in their assembled relationship.

As shown in FIGS. 4–8, friction link 110 lies in face to face contact with the vertical flange 112 of the main angle 52. The friction link 110 has a longitudinally extending slot 114, and the vertical arm 112 of main angle 52 also has a longitudinally extending slot 116 which is at least partially overlapped by friction link 110. The friction link is secured in face to face relationship with the vertical flange 112 by means of two rivet assemblies 118 and 120, each of which includes a rivet 122, tension washer 124 and flat washer 126. As shown in FIG. 8, each of the rivet assemblies 118 and 120 extends through one of the slots 114 and 116 and is anchored in a hole opposite its respective slot. That is, rivet assembly 118 is fixed to the vertical flange 112 of main angle 52 and slides within slot 114 while rivet assembly 120 is fixed to the friction link 110 and slides within slot 116. The tension washers 124 force the link 110 and flange 112 tightly against one another to create a substantial friction load which resists relative movement between the flange 112 and the friction link 110. While the slots 114 and 116 allow longitudinal motion of the friction link on the face of the vertical flange 112 of the main angle 52, the load applied by the tension washers substantially opposes that motion.

As is evident in the drawings, the rivet assembly 120 also serves to connect the control link 88 to the friction link 110. Therefore, as the sofa bed frame 14 moves from the position shown in FIG. 1 to the position of FIG. 3, damping is provided by the friction link 11. It will be noted in FIG. 1 that when the front section of the sofa bed frame is in the closed position, i.e. the front tube 72 and front leg 78 are disposed horizontally and parallel to the main angle 52, the friction link 100 is in the extreme left position with the rivet assembly 118 disposed at the right end of the slot 114 in the friction link (see also FIG. 4). As the front leg is raised to the position shown in FIG. 2, the control link 88 pulls the friction link to the right by virtue of its connection to the friction link by the rivet assembly 120. It will be noted in FIG. 5 that the two rivet assemblies are disposed intermediate the ends of the slots 114 and 116 With continued opening of the sofa bed frame to the position shown in FIG. 3, the control link 88 pulls the friction link 110 to the right until it assumes its other extreme position (see FIG. 6). Continued motion of the friction link on the vertical flange 112 is prevented by the rivet assemblies 118 and 120 engaging the left end of lot 114 and the right end of slot 116, respectively. Thus, during the motion of the front tube and front leg from the closed position of FIG. 1 to the fully opened position of FIG. 3, the friction link provides damping for the assembly to prevent the rapid opening of the frame, even under the influence of the substantial forces which may be exerted by a heavy mattress compressed within the sofa bed frame. In that manner, the operator is fully protected from any sudden, rapid opening of the sofa bed frame, which could cause the front leg or front tube to strike the operator.

From the foregoing description, it will be appreciated that the relatively inexpensive and uncomplicated mechanism added to the sofa bed frame 14, comprising the friction link and rivet assemblies adds a very substantial safety factor to the mechanism. The device works efficiently without significant added manufacturing costs, and a much safer product results.

Having described this invention in detail, those skilled in the art will appreciate that man modifications may be made of this invention without departing from its spirit. For example, under certain conditions, it may be desired to increase the load imposed by the friction link 110 and this may be accomplished by providing additional rivet assemblies in the slot 114 or in additional slots formed in the link 110. Therefore, it is not intended that the breadth of this invention be limited to the specific embodiment illustrated and described. Rather, it is intended in the scope of this invention be determined by the appended claims and their equivalents.

What is claimed is:

1. A sofa bed frame movable from a closed, sofa configuration to an open, bed configuration comprising a main angle and a rear leg for supporting the front end of the main angle when the frame is in the bed configuration, a center angle pivotally connected at one end to the front end of the main angle, said center angle being coplanar with the main angle when the frame is in the bed configuration and substantially perpendicular to the main angle when the frame is in the sofa configuration, a front tube pivotally connected to the other end of the center angle and being generally coplanar with the main and center angles when the frame is in the bed configuration and lying in a plane substantially parallel to and spaced above the main angle when the frame is in the sofa configuration, a front leg pivotally connected to the front tube for supporting the front tube when the frame is in the bed configuration, a front leg lock link pivotally mounted intermediate its ends to the center angle and connected at one end to the front leg, a lock link pivotally connected at one end to the other end of the front leg lock link and at its other end to the main angle, a friction link in face to face relationship with the main angle, fastening means including a friction generating device connecting the friction link to the main angle and permitting movement of the friction link on the main angle only under substantial friction, and a control link pivotally connected at one end to the lock link and at its other end to the friction link, said control link dragging the friction link on the face of the main angle when the frame is moved from the sofa to bed configuration.

2. A sofa bed frame as described in claim 1, wherein the fastening means connecting the friction link to the main angle includes a slot in the friction link, a rivet connected to the main angle and extending through the slot, and a tension washer on the rivet urging the friction link and main angle against one another.

3. A sofa bed frame as described in claim 2, wherein said fastening means also includes a second slot in the main angle, a second rivet connected to the friction link and extending through the second slot, and a tensioning washer on the second link urging the friction link and main angle against one another.

4. A sofa bed frame movable from a closed, sofa configuration to an open, bed configuration comprising a main angle and a rear leg for supporting the front end of the main angle when the frame is in the bed configuration, a center angle pivotally connected at one end to the front end of the main angle, said center angle being coplanar with the main angle when the frame is in the bed configuration and substantially perpendicular to the main angle when the frame is in the sofa configuration, a front tube pivotally connected to the other end of the center angle and being generally coplanar with the main and center angles when the frame is in the bed configuration and lying in a plane substantially parallel to and spaced above the main angle when the frame is in the sofa configuration, a front leg pivotally connected to the front tube for supporting the front tube when the frame is in the bed configuration, a friction link slidably mounted in face to face relationship with the main angle, linkage means connected between the front tube and the friction link for sliding the friction link over the face of the main angle when the frame is moved from sofa to bed configuration, and load imposing means operatively connected to the friction link and the main angle urging the two together so as to place a substantial friction load on the linkage means to resist movement of the link on the angle and thereby prevent rapid opening of the frame from the sofa to bed configuration.

5. A sofa bed frame as described in claim 4, wherein said load imposing means includes a rivet connected to the main angle and extending through a slot in the friction link, and a spring washer on the rivet.

6. A sofa bed movable between a closed, sofa configuration and an open, bed configuration comprising a frame having a main angle disposed in a substantially horizontal plane when the frame is in a bed configuration, a front section pivotally linked to the main angle and substantially coplaner with the main angle when the frame is in the bed configuration and substantially parallel to the main angle when the frame is in the sofa configuration, an over center lever mechanism connected to the front section for locking the front section of the frame in the sofa configuration, and a friction damper connected to the over center lever mechanism for resisting the opening of the front section to the bed configuration when the over center lever mechanism passes over center for preventing the front section from rapidly opening and injuring the operator, said friction damper including a link slidably mounted on and in face to face relationship with the main angle and connected to the over center lever mechanism, said mechanism causing the link to slide on the main angle when the frame is opened, and spring means urging the link and angle against one another to create friction resisting movement of the link on the angle.

7. A sofa bed having a bed frame movable from a closed, sofa configuration to an open, bed configuration and a mattress on the frame, said frame comprising a main angle disposed in a substantially horizontal plane when the frame is in a bed configuration, a front section pivotally linked to the main angle and substantially coplanar with the main angle when the frame is in the bed configuration and substantially parallel to and spaced above the main angle when the frame is in the sofa configuration, and means including a friction damper connected between the front section and the main angle for damping the movement of the front section from sofa to bed configuration, said friction damper including a link slidable on the main angle, and means for imposing a force on one of the angle and link urging them against one another to resist opening of the frame.

8. A sofa bed frame as described in claim 7, wherein a pair of pins and slots join the link and angle together in face to face relationship.

9. A sofa bed movable between a closed, sofa configuration and an open, bed configuration comprising a frame having a main angle disposed in a substantially horizontal plane when the frame is in a bed configuration, a front section pivotally linked to the main angle and substantially coplanar with the main angle when the frame is in the bed configuration and substantially parallel to the main angle when the frame is in the sofa configuration, an over center lever mechanism connected to the front section for locking the front section of the frame in the sofa configuration, said mechanism including a leg pivotally connected to the front section and a leg lock link connected to the leg, said leg lock link passing over the pivotal connection between the leg and the front section when the sofa bed frame moves from the sofa to the bed configuration, a center angle connected between the main angle and the front section, said leg lock link being pivotally connected intermediate its ends to the center angle, and a friction damper connected to the over center lever mechanism for resisting the opening of the front section to the bed configuration when the over center lever mechanism passes over center for preventing the front section from rapidly opening and injuring the operator.

10. A sofa bed having a bed frame movable from a closed, sofa configuration to an open, bed configuration and a mattress on the frame, said frame comprising a main angle forming part of the bed frame and disposed in a substantially horizontal plane when the frame is in a bed configuration, a front section pivotally linked to the main angle and substantially coplanar with the main angle when the frame is in the bed configuration and substantially parallel to and spaced above the main angle when the frame is in the sofa configuration, and means including a friction damper connected tot he front section and mounted on the frame damping the movement of the front section from sofa to bed configuration, said friction damper including a link slidable on the frame, and means for imposing a force on one of the frame and link urging them against one another to resist opening of the frame.

11. A sofa bed frame as described in claim 10 wherein pins and slots join the link and frame in face to face relationship.

12. A sofa bed as described in claim 11 wherein said means includes a linkage connected between the front section and the link for causing the link to slide on the frame when the frame is opened.

13. A sofa bed having a bed frame movable from a closed, sofa configuration to an open, bed configuration and a mattress on the frame, said frame comprising a main angle forming part of the bed frame and disposed in a substantially horizontal plane when the frame is in a bed configuration, a front section pivotally linked to the main angle and movable from a first position when the frame is in the bed configuration to a second position in front of the main angle when the frame is in the sofa configuration, and means including a friction damper connected to the front section and mounted on the frame damping the movement of the front section from sofa to bed configuration, said friction damper including a link slidable on the frame, and means for imposing a force on the frame and link urging them against one another to resist opening of the frame.

* * * * *